US010400546B2

(12) United States Patent
Kehoe

(10) Patent No.: US 10,400,546 B2
(45) Date of Patent: Sep. 3, 2019

(54) FLOW REVERSING DEBRIS REMOVAL DEVICE WITH SURFACE SIGNAL CAPABILITY

(71) Applicant: BAKER HUGHES, A GE COMPANY, LLC, Houston, TX (US)

(72) Inventor: Stephen F. Kehoe, Bakersfield, CA (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 227 days.

(21) Appl. No.: 15/484,800

(22) Filed: Apr. 11, 2017

(65) Prior Publication Data

US 2018/0291706 A1 Oct. 11, 2018

(51) Int. Cl.

| | |
|---|---|
| ***E21B 34/10*** | (2006.01) |
| ***E21B 37/00*** | (2006.01) |
| ***E21B 43/08*** | (2006.01) |
| ***E21B 43/38*** | (2006.01) |

(52) U.S. Cl.

CPC ..... *E21B 34/10* (2013.01); *E21B 37/00* (2013.01); *E21B 43/08* (2013.01); *E21B 43/38* (2013.01)

(58) Field of Classification Search

CPC ..... E21B 34/10; E21B 37/00; E21B 43/08; E21B 43/38

See application file for complete search history.

(56) References Cited

U.S. PATENT DOCUMENTS

| | | | | |
|---|---|---|---|---|
| 6,607,031 | B2 | 8/2003 | Lynde et al. | |
| 8,056,622 | B2 | 11/2011 | Lynde | |
| 8,474,522 | B2 | 7/2013 | Lynde et al. | |
| 8,607,857 | B2 | 12/2013 | Lynde et al. | |
| 2007/0272404 | A1* | 11/2007 | Lynde | E21B 27/005 166/99 |
| 2012/0152522 | A1 | 6/2012 | Lynde | |
| 2014/0014347 | A1* | 1/2014 | Adam | E21B 34/14 166/308.1 |
| 2014/0260725 | A1* | 9/2014 | Weber | F16H 19/06 74/89.13 |

* cited by examiner

*Primary Examiner* — Caroline N Butcher
(74) *Attorney, Agent, or Firm* — Shawn Hunter

(57) ABSTRACT

A movable sleeve is actuated to cover eductor outlet ports in the event of loss of through flow. The eductor reduces pressure in the tool on one side of the sleeve as compared to hydrostatic on another side of the sleeve so that the sleeve is urged to move in an uphole or downhole direction to cover the eductor outlet ports. This movement reverses circulation direction through the housings in an effort to push debris off a clogged screen with reverse flow. To return the sleeve to its initial position the inlet to the device is inserted into debris and the surface pumps are started to create an unbalanced force on the sleeve to move it back to the original position free of the eductor outlet ports. The sleeve configuration can be reversed so that low pressure from a flow blockage urges the sleeve down to close the eductor ports.

17 Claims, 6 Drawing Sheets

FLOW REVERSING DEBRIS REMOVAL DEVICE WITH SURFACE SIGNAL CAPABILITY

FIELD OF THE INVENTION

The field of the invention is downhole debris retention devices and more particularly devices that use an eductor to collect debris and to draw fluid through a screen before reaching the eductor and ways to clean the screen or remove blockages of debris below the device and a way to determine more equivocally than can currently be determined if the screen is blinded with debris.

BACKGROUND OF THE INVENTION

The flow regime through eductor type debris collection devices is shown in U.S. Pat. No. 8,607,857 and US 2012/0152522. In essence the debris laden fluid is drawn into the bottom inlet pipe that has a debris collection volume around it. Other inlet and debris collection chamber configurations for such devices are also known. As the drawn debris laden fluid exits the inlet pipe the velocity is reduced due to increased cross-section and the heavier debris is redirected laterally so that it can fall into the annular shaped collection chamber around the inlet pipe. The flow continues up with some of the smaller debris that did not settle out into the annular collection chamber and passes through a screen on the way further up to an eductor inlet. The motive fluid to the eductor comes from the surface on a tubing string. The motive fluid reduces the pressure at the eductor inlet to draw the screened fluid into the eductor body and out the eductor exit. The drawn fluid mixes with the motive fluid in the eductor and the combined flow exits the device housing and can go in a downhole direction to the debris laden fluid entrance or uphole.

When using such devices one of the longstanding issues is how to alert surface personnel that there is a plugging problem and how to deal with the problem. In debris retention devices space is always at a premium and limits the practicality of some solutions to these issues. One design tries to mechanically vibrate debris off a clogged screen as illustrated in U.S. Pat. No. 8,056,622. Flow diversion schemes are discussed in U.S. Pat. No. 8,474,522 actuated with axial tool movement or pressure to move a piston. Other types of debris collection devices have sleeves shift responsive to tool movement in the hole to redirect fluid streams. One example is U.S. Pat. No. 6,607,031.

In an eductor type debris removal device a flow sensor has been proposed to sense low flow and move a sleeve over an eductor outlet port to redirect flow into the screen in a reverse direction and to give a surface signal such as with mud pulses or a pressure buildup at the surface to name a few signal options. This device proposed using a motor driven sleeve using a ball screw or thread to drive the sleeve. While using all these components could have been possible in the larger sizes, in the smaller sizes the offered design elements may not fit and the working environment is tough on sensors that require a power source in the form of a battery with a finite life.

The present invention offers a simple device responsive to loss of flow and taking advantage of the pressure reduction created by an eductor trying to draw against a clogged filter. The clogging may also be below the filter. A pressure differential across a selectively movable barrier makes that barrier move to close outlet ports on the eductor. This forces flow backwards through a screen to clean it. Further flow going backwards can also break loose a jam due to accumulated debris at the inlet to the debris removal device. The reverse flow builds pressure on the movable barrier to ultimately force the movable barrier down and have it re-latch into its original position at which time normal circulation is resumed and debris laden flow is again drawn into the bottom of the tool. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A movable sleeve is actuated to cover eductor outlet ports in the event of loss of through flow. The eductor reduces pressure in the tool on one side of the sleeve as compared to hydrostatic on another side of the sleeve so that the sleeve is urged to move preferably in an uphole direction to cover the eductor outlet ports but movement downhole is also contemplated. This movement reverses circulation direction through the housings in an effort to push debris off a clogged screen with reverse flow. To return the sleeve to its initial position the inlet to the device is inserted into debris and the surface pumps are started to create an unbalanced force on the sleeve to move it back to the original position free of the eductor outlet ports. The sleeve configuration can be reversed so that low pressure from a flow blockage urges the sleeve down to close the eductor ports.

DETAILED DESCRIPTION OF THE PREFERRED EMBODIMENT

Figure 3:
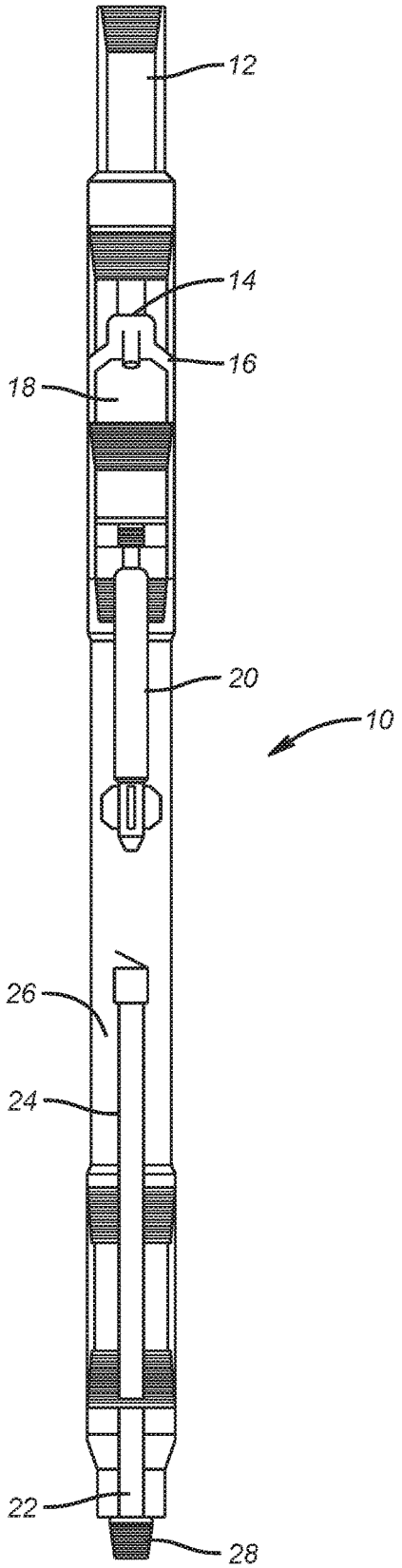
FIG. 3 is a sectional view of an eductor type debris collector and the general parts arrangement.

FIG. 3 shows a schematic representation of the flow regime in a debris removal tool 10. Tubing string flow enters at 12 and goes on to eductor inlet(s) 14. The eductor outlet(s) is 16. As a result of the functioning eductor, the pressure is lowered in chamber 18 to draw fluid up through screen 20. Debris laden fluid is drawn into inlet 22 from the reduced pressure in chamber 18. After exiting the inlet tube 24 the heavier solids drop out due to the sudden velocity decrease when exiting tube 24. The heavier debris settles into annular chamber 26 for collection. The fluid with some debris still entrained goes up to screen 20 and to chamber 18 leaving behind more debris on screen 20. Eductor exhaust from outlet(s) 16 splits and some goes downhole while most returns uphole toward the surface. A string can be connected at lower thread 28 and can include equipment such as a spear or an overshot for a fishing operation.

Figure 1:
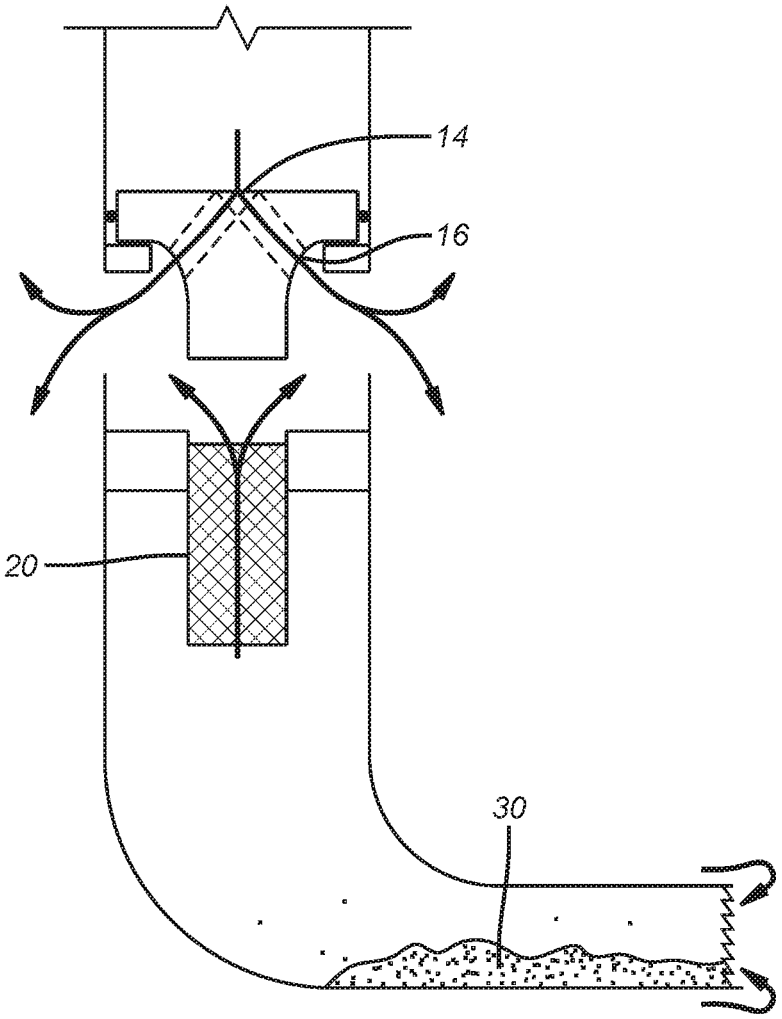
FIG. 1 shows the flow scheme in an eductor type debris collector with sand accumulating at the inlet.
Figure 2:
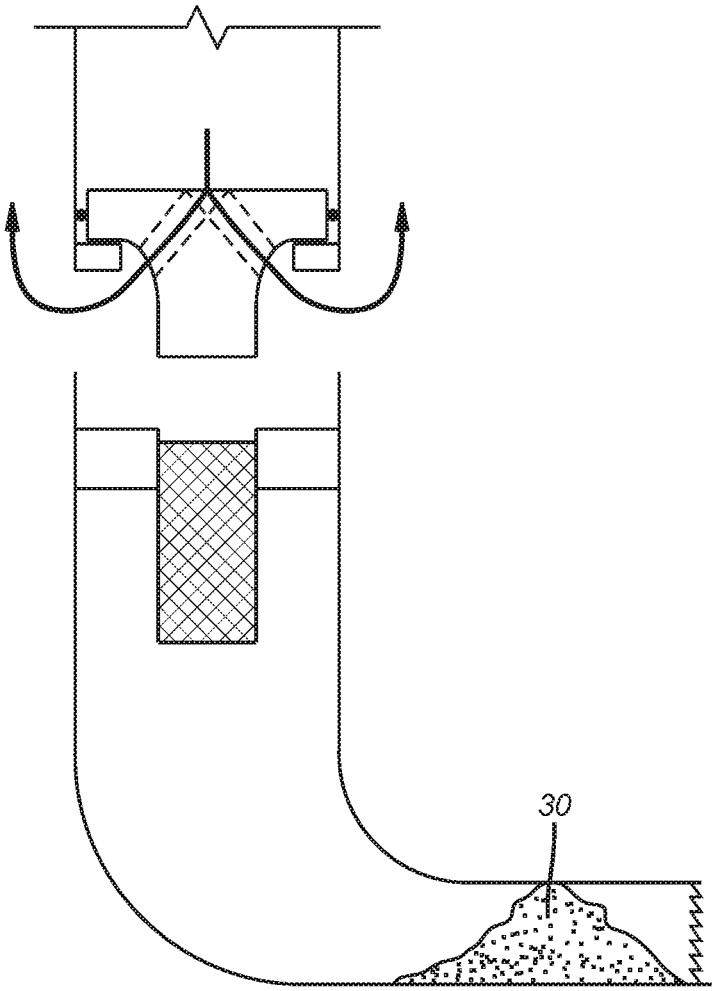
FIG. 2 is the view of FIG. 1 showing a blockage at the inlet.
Figure 4:
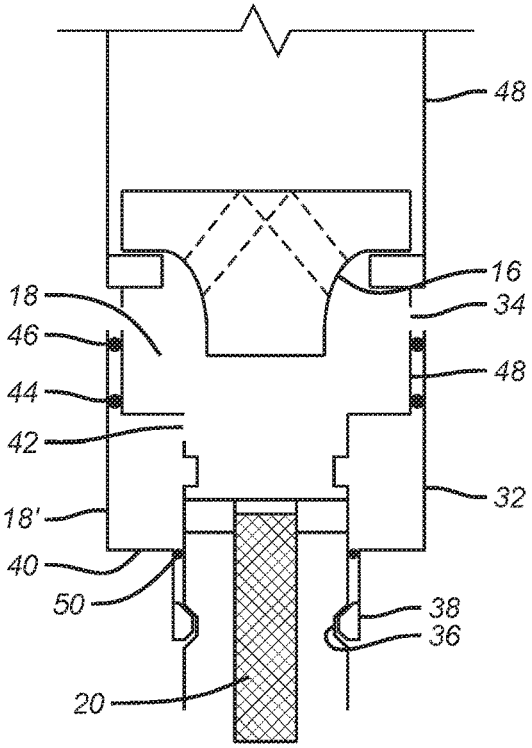
FIG. 4 shows the flow reversing sleeve in the run in position.
Figure 5:
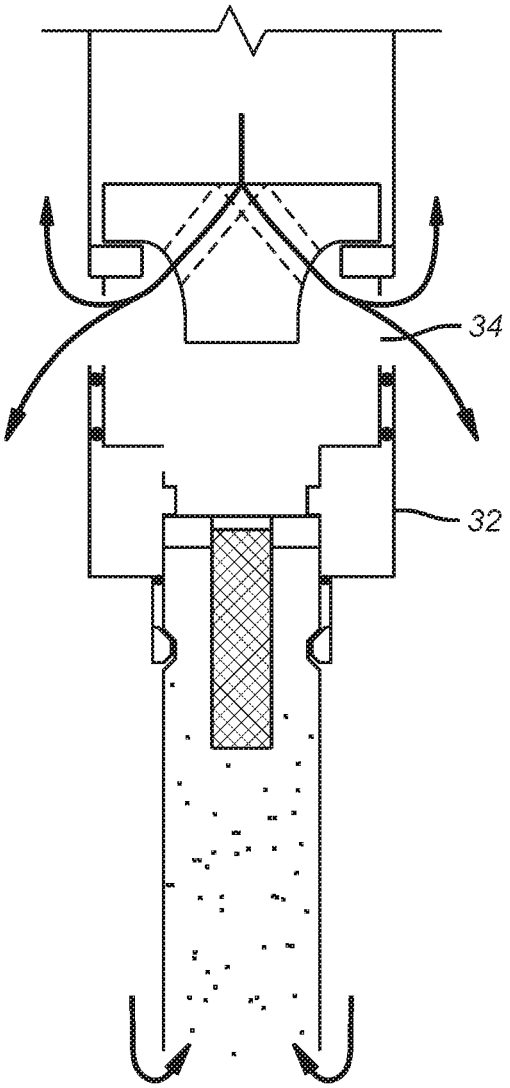
FIG. 5 is the view of FIG. 4 with motive fluid applied to the eductor.

As shown in a simplified diagram of the tool 10 in FIG. 1 there are two ways the tool can stop functioning. One is an accumulation of debris 30 at the inlet as shown in FIGS. 1 and 2 and another is if the spear that is not shown engages the fish that is also not shown for a grip. In either event flow into inlet tube 24 stops. When this happened in the past, surface personnel had no way to know. The present invention addresses this issue by employing a simple device of a movable cap 32 that responds to reduced pressure in chamber 18 when fluid flow into inlet tube 24 stops from plugging or obtaining a fish in a fishing operation. As shown in FIG. 4, eductor outlet(s) 16 are aligned with a housing exit 34 that is normally open. Cap 32 is releasably latched at groove 36 with a collet 38 extending from bottom surface 40. Chamber 18 is now split into two communicating compartments 18 and 18' which communicate through port or ports 42. Upper seals 44 and 46 seal between cap 32 and the outer housing 48. Groove or grooves 36 are also in the outer housing 48. Lower seal or seals 50 also seal between the outer housing 48 and the cap 32. FIGS. 4 and 5 show normal flows through the tool with the cap 32 in a lower position so that outer housing exit ports 34 are open.

Figure 6:
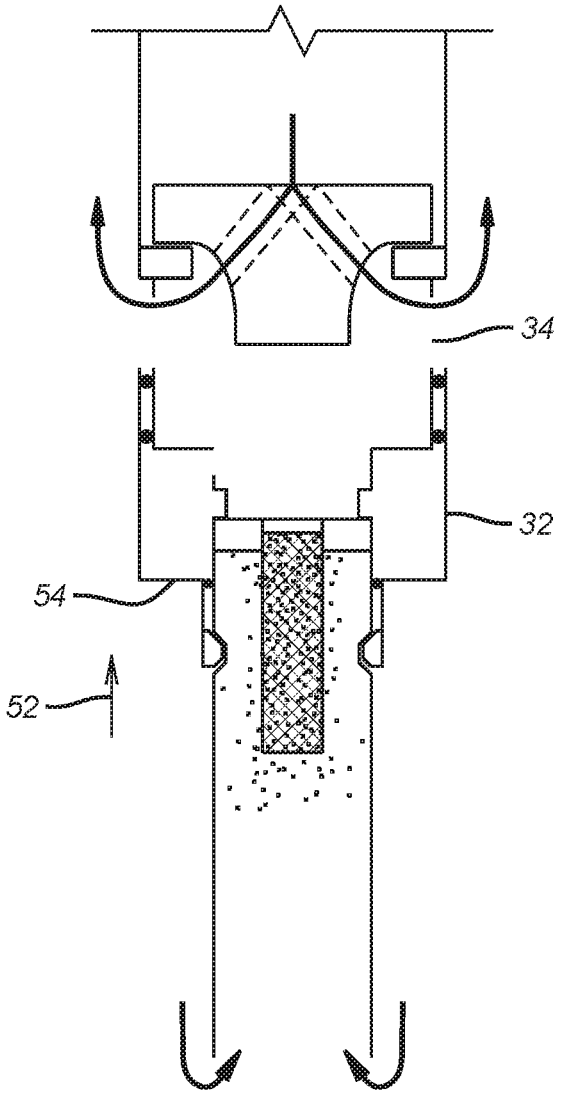
FIG. 6 is the view of FIG. 5 with the screen blocked.

In FIG. 6 there is a blockage at inlet 22 and as a result the pressure is reduced in chamber 18, 18' putting a net force in the direction of arrow 52 because there is now a higher pressure on surface 54 from the borehole than on the other side of that surface from the chamber 18,18'. The cap 32 will be drawn up in the direction of arrow 52 until the housing ports 34 move to a closed position. When that happens the flow direction is changed and exiting flow from outlet(s) 16 can no longer go out through ports 34 as cap 32 has them closed off. Instead the flow goes backwards into the inside of screen 20 as shown by arrow 56. As a result debris 58 that could have been clogging the screen 20 on its outside surface can get pushed off the outside surface to fall away and get captured in collection chamber 26. It should be noted that the movement of cap 32 in the direction of arrow 52 is made possible by the collet or collets 38 releasing from respective grooves 36. This redirection of outlet flow from eductor outlet(s) 16 also comes with a rise in internal pressure in the tool 10 that is communicated to the surface through string 12. If there is a fishing tool connected to thread 28 it is an indication that the fish has been caught.

Figure 7:
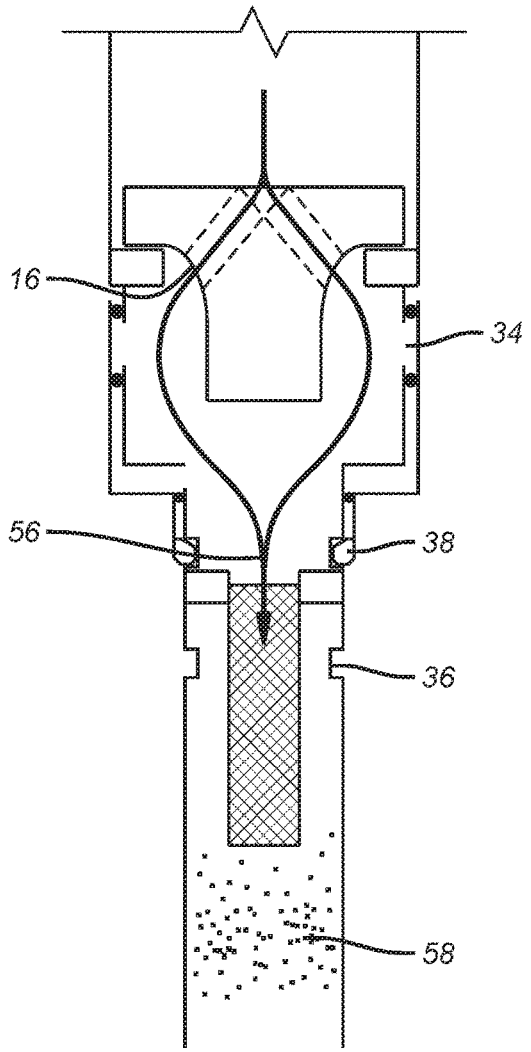
FIG. 7 is the view of FIG. 6 with the sleeve drawn up to cover the eductor exit ports.
Figure 8:
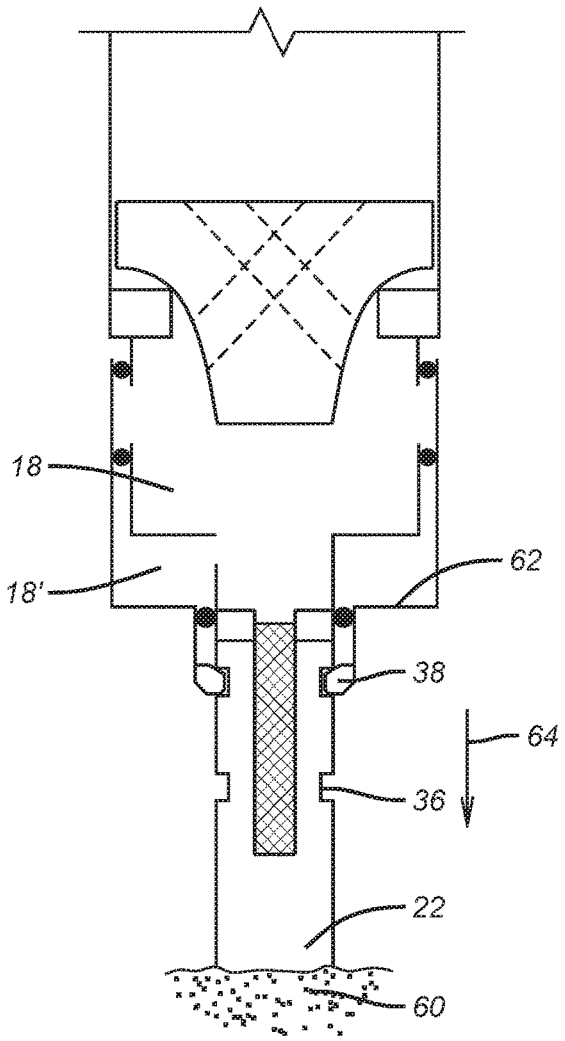
FIG. 8 shows using pressure from above to push the sleeve down to reopen the eductor exit ports.

FIG. 8 shows a way to return the cap 32 to a position with ports 34 open as in FIGS. 4 and 5 after the FIG. 7 position is reached due to a lowering of pressure in chamber 18, 18'. In essence the inlet 22 is effectively blocked with setting down weight so that the debris entrance is buried in the debris 60. This allows pressure to build in chamber 18, 18' to the point of a net force on surface 62 in the direction of arrow 64. As a result the cap 32 is pushed down so that collet(s) 38 can re-latch in groove(s) 36 and normal debris removal operation can resume as in FIGS. 4 and 5.

Figure 9:
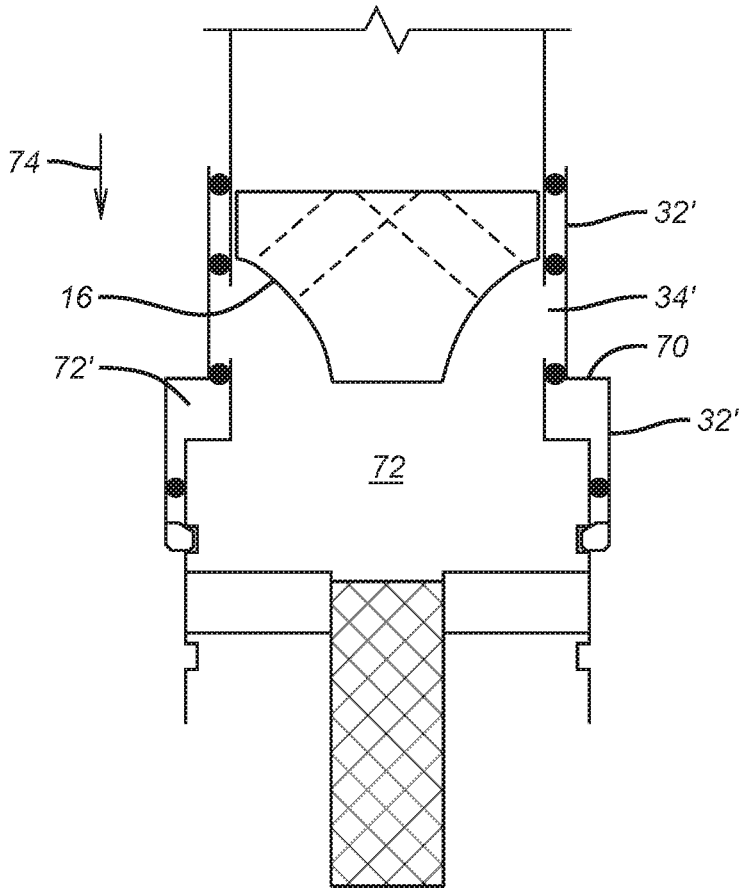
FIG. 9 is an alternative sleeve design that moves down if the screen blocks.

FIG. 9 shows cap 32' inverted so that it has a closed top 70 such that reduction in pressure in chamber 72, 72' results in movement of cap 32' in the direction of arrow 74 so that outer housing ports 34' close as the upper end of the cap 32' moves side openings in cap 32' away from alignment with outer housing openings 34' to close them. FIG. 9 shows the ports 34' still open as the pressure in chamber 72, 72' is starting to be reduced. At a predetermined pressure reduction in chamber 72, 72' there will be a net downward force on surface 70 in the direction of arrow 74 which will move cap 32' and close off outer housing ports 34'. It should be noted that any exiting flow from outlets 16 at this time will also impart a force component on the upper end of the cap 32' as initial movement misaligns the ports in cap 32' with the outer housing ports 34'.

Those skilled in the art will appreciate that the movable cap that redirects the eductor flow responsive to pressure reduction due to debris inlet blockage with debris or with a captured fish has many advantages. One is that it is simple in design and another is that it is reliable in operation while taking up minimal space in situations where space is usually at a premium. It gives a surface pressure signal while pushing debris off a screen with reversing flow. The cap can be simply repositioned for continuation of debris removal service with pressuring up from the surface with preferably placing the inlet in debris to close off the inlet. The cap can be configured for uphole movement to redirect flow or downhole movement to redirect flow. A latch system can hold the cap in the normal operating position for capturing debris. No complex motors or stored power is needed as movement is induced from the inlet clogging and an ensuing pressure reduction in a chamber as the eductor continues to lower the pressure above the internal screen.

The above description is illustrative of the preferred embodiment and many modifications may be made by those skilled in the art without departing from the invention whose scope is to be determined from the literal and equivalent scope of the claims below:

I claim:

1. A debris collection apparatus for borehole use, comprising:

a housing having a debris laden fluid inlet adjacent a lower end and a pressurized fluid inlet adjacent an upper end leading into at least one eductor, said eductor comprising an outlet aligned with at least one wall opening in said housing;

said housing further comprising a debris retention volume and a screen so that said eductor can draw fluid through said screen into an inlet chamber;

a barrier movably supported to said housing for selective blocking of said at least one wall opening in said housing responsive to a predetermined pressure reduction in said inlet chamber, and wherein the barrier is movable with respect to the screen during said selective blocking;

the barrier comprises a closed end cap; and said cap divides said inlet chamber into two communicating segments through a port in said housing.

2. The apparatus of claim 1, wherein:

said barrier moves in an uphole direction to block said at least one wall opening.

3. The apparatus of claim 1, wherein:

said barrier moves in a downhole direction to block said at least one wall opening.

4. The apparatus of claim 1, wherein:

movement of said barrier to block at least one wall opening reverses flow in said housing through said screen.

5. The apparatus of claim 1, wherein:

movement of said barrier to block said at least one wall opening raises pressure at said pressurized fluid inlet to create a signal at a surface location that said barrier has moved to block said wall opening.

6. The apparatus of claim 1, wherein:

said barrier is releasably attached to said housing in a position where said at least one wall opening is open.

7. The apparatus of claim 6, wherein:

said releasable attachment comprised at least one collet on said cap and at least one groove on said housing to selectively retain said at least one collet.

8. The apparatus of claim 1, wherein:

said cap comprises a closed end that defines one of said segments such that a reduction of pressure in said segment defined by said cap creates an unbalanced force on said closed end as between said inlet chamber segment and fluid in the borehole outside said closed end.

9. The apparatus of claim 8, wherein:

said one of said segments sealed against an outer surface of said housing.

10. A debris removal method from borehole fluids, comprising drawing in debris laden fluid into a housing with an eductor, said housing comprising an opening aligned with an eductor exit;

retaining some debris in a volume in said housing;

filtering some debris with a screen before fluid enters a chamber at an inlet for said eductor;

blocking said opening with a barrier movable responsive to a pressure reduction in said chamber;

configuring said barrier as a cap with a closed end;

communicating an interior of said cap to said chamber;

moving said cap with respect to said housing to block said opening with a pressure differential between the interior of said cap and borehole pressure on an exterior of said cap; and the barrier is movable with respect to the screen during said blocking.

11. The method of claim 10, comprising:

reducing pressure in said chamber responsive to a blockage at a debris laden inlet to said housing.

12. The method of claim 11, comprising:

creating said blockage with accumulated debris or by catching a fish with a tool attached to said housing.

13. The method of claim 10, comprising:

reversing flow through said screen when said barrier blocks said housing opening.

14. The method of claim 10, comprising:

supplying pressure to an inlet to said eductor from a tubular string extending to a surface location.

15. The method of claim 14, comprising:

reopening said opening by moving said barrier with application of pressure at said inlet to said eductor while blocking a debris laden fluid inlet in said housing;

releasably latching said barrier to said housing using at least one collet on said barrier reengaging at least one groove on said housing.

16. The method of claim 10, comprising:

moving said cap in an uphole direction to block said opening.

17. The method of claim 10, comprising:

moving said cap in an downhole direction to block said opening.

* * * * *